US006558610B1

(12) United States Patent
Rodgers et al.

(10) Patent No.: US 6,558,610 B1
(45) Date of Patent: May 6, 2003

(54) PROCESS AND APPARATUS FOR COLLECTING CONTINUOUS BLOW SPUN FIBERS

(75) Inventors: John A. Rodgers, Dayton, TN (US); Daniel F. Rossillon, Ponca City, OK (US); Roger A. Ross, Flat Rock, AL (US)

(73) Assignee: Conocophillips Company, Houston, TX (US)

( * ) Notice: Subject to any disclaimer, the term of this patent is extended or adjusted under 35 U.S.C. 154(b) by 119 days.

(21) Appl. No.: 09/603,607

(22) Filed: Jun. 26, 2000

Related U.S. Application Data

(62) Division of application No. 09/149,151, filed on Sep. 8, 1998, now abandoned.
(60) Provisional application No. 60/066,275, filed on Nov. 20, 1997.

(51) Int. Cl.[7] ..... D01D 5/12; D01F 9/12; D01F 9/145

(52) U.S. Cl. ..... 264/555; 264/103; 264/210.8; 264/211.11; 264/211.12; 264/211.14

(58) Field of Search ..... 264/103, 210.8, 264/211.11, 211.12, 211.14, 555

(56) References Cited

U.S. PATENT DOCUMENTS 5,648,041 A * 7/1997 Rodgers et al. ..... 264/555

* cited by examiner

*Primary Examiner*—Leo B. Tentoni

(57) ABSTRACT

The present invention provides a process and apparatus for blow spinning continuous fibers. The novel process utilizes a tensioning device to preclude slack in the fiber. The present invention also provides novel fiber products which utilize continuous fibers prepared by a blow spinning process.

9 Claims, 1 Drawing Sheet

PROCESS AND APPARATUS FOR COLLECTING CONTINUOUS BLOW SPUN FIBERS

This is a divisional application of copending Ser. No. 09/149,151 filed on Sep. 8, 1998, now abandoned, which is based on Provisional Patent Application Serial No. 60/066,275 filed on Nov. 20, 1997.

BACKGROUND AND SUMMARY OF THE INVENTION

A. Summary of the Invention

The present invention provides a process and apparatus for generating a continuous one dimensional array of high strength, small diameter pitch based carbon fibers. In general, the present invention provides a blow spinning process which creates a blow spun product having melt spun product type characteristics at blow spinning speeds. Thus, the current invention improves product uniformity and production economics. While the present invention is particularly useful in blow spinning fibers from carbonaceous pitch, other uses will be apparent from the following disclosure.

B. Background of the Invention

Since blow spinning operations are well known in the art, they will be discussed only in general terms. A typical blow spinning process utilizes a spinnable substance, an attenuating media, normally a gas, and a spinning die containing fiber forming capillaries. During the spinning process, fibers exit the capillaries and are contacted by the attenuating media which draws or stretches each fiber increasing its length while decreasing its diameter. Since the attenuating media is normally a gas, the quench rate of the fibers is also affected.

Typically, fibers prepared by blow spinning processes are short discontinuous fibers having lengths of less than two inches. In contrast, melt spun fibers are generally continuous fibers with essentially infinite lengths. Normally, the fiber length of a melt spun fiber is chosen by design, not dictated by the process of producing the fibers. Additionally, melt spun fibers have better denier uniformity than blow spun fibers.

Several types of dies may be used for blow spinning fibers. In general, blow spinning dies are identified by the method of directing the attenuating gas into contact with the fibers. Two common designs are annular and slot dies. Specifically, in an annular die, the attenuating gas exits an annulus formed around each capillary and flows in a direction parallel to the fiber. Attenuation occurs due to the drag of the gas on the fiber. In slot dies, the attenuating gas exits slots on either side of a die tip contacting the fiber at an angle. The angle of contact, as determined by the die geometry, is optimized for the spinnable substance to obtain desired fiber characteristics. The present invention has equal application for all types of blow spinning dies.

Typical blow spinning methods allow the spun fibers to fall to a collection surface following attenuation. Depending upon the composition of the fibers, this method produces a two or three dimensional batt of short randomly arranged fibers. Fibers collected in this manner may contain undesirable bends and kinks resulting in lower fiber tensile strength. The primary cause of the bending and kinking of the fibers is believed to be the turbulence generated by the attenuating gas during the quenching of the fibers.

Those skilled in the art have recognized that the process of collecting fibers is a critical step in achieving high tensile strength fibers. Prior art methods for collecting blow spun fibers typically increased the number of bent and kinked fibers by collecting them in a three dimensional random batt. Recent U.S. Pat. No. 5,648,041 demonstrates the collection of fibers in a two dimensional batt. However, the means for achieving the two dimensional batt requires additional processing apparatus and strict control of the attenuating gas. As demonstrated by melt spinning processes, manufacturers have long recognized that unidirectional fiber lay-down or collection, for example on a spindle or bobbin, would produce the ultimate fiber properties. However, prior to the current invention, the means for achieving this goal in a blow spinning process had not been discovered.

The present invention overcomes the difficulties previously associated with blow spinning fibers by providing an apparatus and process for collecting continuous, blow spun fibers. Additionally, the process and apparatus of the present invention provides for unidirectional collection of the continuous fibers. As used herein, the term "continuous fibers", means fibers having an essentially infinite length. Interruption in the length of continuous fibers generally occurs purposefully or due to a manufacturing problem. Further, fibers generated by the present invention have improved fiber uniformity and tensile strength. Finally, the present invention provides a blow spinning process which generates a melt spun type product at a rate equivalent to blow spinning.

BRIEF DISCLOSURE OF THE INVENTION

The present invention provides an apparatus for blow spinning continuous, infinitely long fibers. The novel apparatus includes a blow spinning die having at least one capillary for forming a fiber and means for directing an attenuating gas into contact with the fiber as it exits the capillary. The apparatus also provides a means for placing tension on the fiber until it has thermoset or quenched, i.e. solidified. Further, the present invention optionally provides for the removal of gases and vapors from within the fiber array or bundle prior to collecting the fibers on a receiving device.

Further, the present invention provides a process for preparing continuous blow spun fibers. The inventive process prepares fibers by heating a spinnable substance and forming fibers by passing the substance through a spinning die. The fibers are attenuated by an attenuation gas. Following attenuation, the process precludes the formation of slack in the fibers by maintaining tension on the fibers by means of a tensioning device. The continuous blow spun fibers may be collected on the tensioning device or a subsequent device such as bobbin or windup.

The present invention additionally provides a process for preparing straight blow spun fibers from a carbonaceous pitch. The novel process utilizes a means for maintaining tension on the fiber to preclude slack prior to thermosetting or quenching the fiber. The present invention additionally includes the step of collecting said fibers as a warp sheet or traversed continuous filament tow on a receiving device. If necessary, the present invention provides for the removal of gases and vapors from the fibers prior to collecting the fibers on the receiving device. Preferably the gases and vapors will be removed by cross-flow ventilation applied to the fibers prior to the receiving device. Finally, the novel process will also be useful when spinning fibers from substances such as but not limited to, carbonaceous pitches, polyamides including nylons, polyesters such as "Dacron®", polypropylenes, polyurethanes including "Lycra®", polyaramides such as "Kevlar®" and liquid crystalline materials such as mesophase pitch, solvated mesophase pitch and Zenite®, where all trademarks are registered trademarks of E. I. du Pont de Nemours and Company.

Additionally, when spinning pitch based fibers, the present invention provides a continuous, straight, blow spun fiber. The fiber is free of kinks, bends and other collection flaws associated with blow spinning which lower the mechanical properties of the fiber. As a result, this invention yields a fiber with a significantly higher tensile strength.

Further, the present invention provides a traversed continuous fiber tow, a warp sheet and an unidirectional filament roving fabric prepared from continuous fibers made by a blow spinning process.

DETAILED DISCLOSURE

Figure 1:
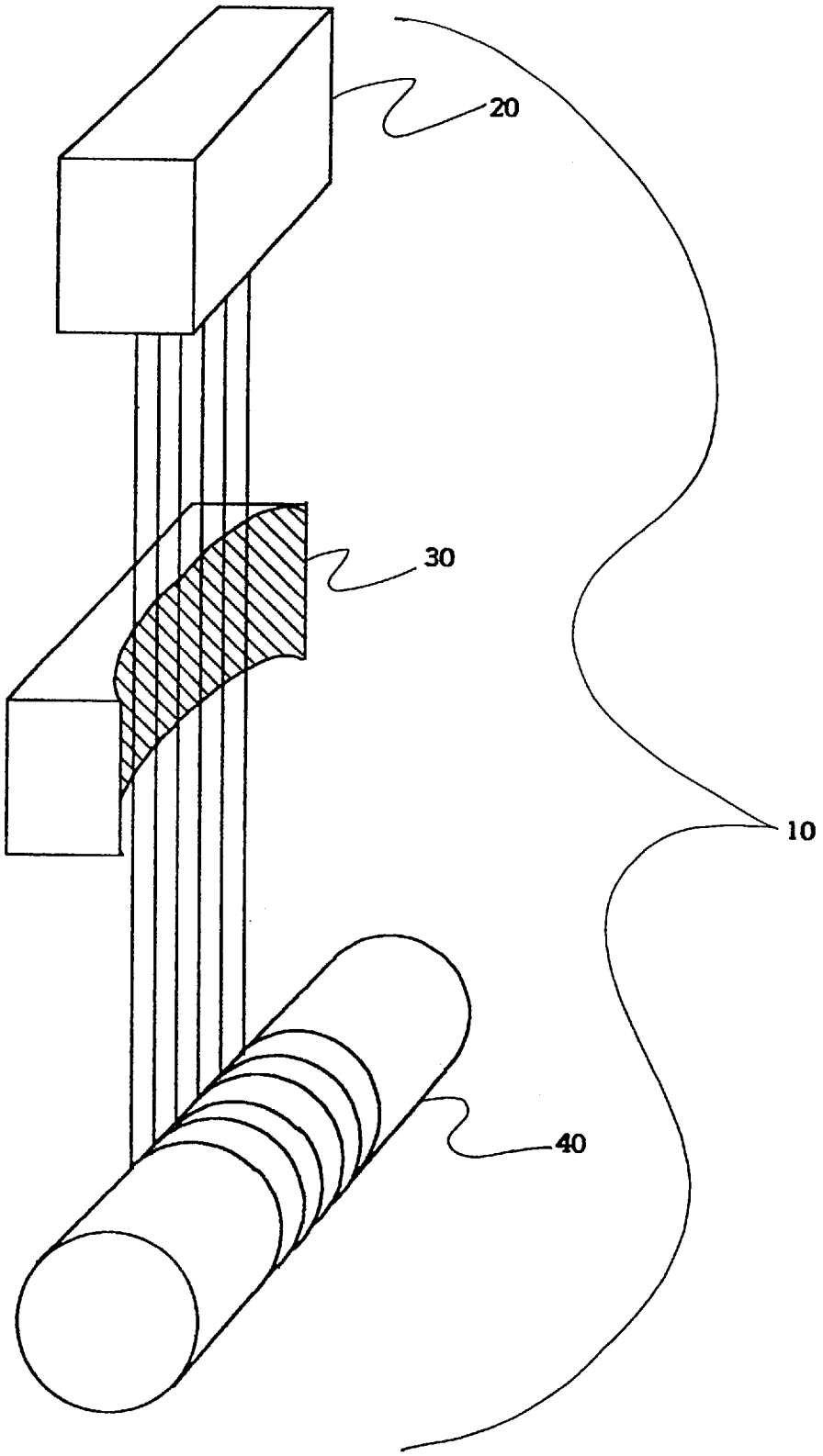
FIG. 1 is a generic depiction of the apparatus of the current invention.

A. Apparatus for Blow Spinning and Collecting Fibers

With reference to the drawing, the present invention provides a blow spinning and fiber collection apparatus 10. Apparatus 10 has a typical blow spinning die represented generically as 20, a vapor removal system 30 and a tensioning device 40 or other suitable means for maintaining tension on the spun fiber.

Blow spinning dies are well known in the art. In fact, as previously discussed, there are several well known variations of blow spinning dies. The current invention is suitable for use with all blow spinning dies. For further information on the function of blow spinning dies please see the following references which are incorporated herein by reference: "Vibration and Stability in the Melt Blowing Process", *Ind. Eng. Chem. Res.,* 1993, 32, 3100–3111 by Rao and Shambaugh; "A Macroscopic View of the Melt-Blowing Process for Producing Microfibers", *Ind. Eng. Chem. Res.,* 1988, 27, 2363–2372, Shambaugh; "Three-Dimensional Temperature Field of Rectangular Array of Practical Air Jets", *Ind. Eng. Chem. Res.,* 1994, 33, 730–735, Mohammed and Shambaugh; "Superfine Thermoplastic Fibers," by Van A. Wente, *Industrial and Engineering Chemistry,* Vol. 48, No. 8, August 1956, pp. 1342–46 and U.S. Pat. Nos. 4,847,125; 4,380,570; and, 5,286,182.

The optional vapor removal system 30 of the current invention is particularly useful when the spinnable substance contains volatile components such as unreacted monomer or the solvent component of solvated pitches. Solvated pitches were developed by the assignee of the current invention and are disclosed in U.S. Pat. Nos. 5,259,947; 5,437,780; 5,501,788; and, 5,538,621 which are incorporated herein by reference. In the preferred embodiment, the vapor removal system 30 is positioned between the die 20 and the tensioning device 40. The preferred vapor removal system utilizes one or more blowers, not shown, or other means to generate a cross-flow or movement of gas or air. The cross-flow ventilation effectively removes hydrocarbon vapors or other entrained components from within the fiber bundle and assists in attaching "out of bundle" filaments. Removal of volatile components from within the fiber array or bundle prior to collection improves the processability of the fiber.

Finally, the apparatus of the current invention includes a tensioning device 40. As shown, device 40 may be as simple as a single bobbin or spool that exerts tension on the continuous, blow spun fiber. Alternatively, additional bobbins, rolls, pins, hot chest and etc. can be incorporated ahead of or after device 40 to accomplish cold draw and thermal setting functions. The exact configuration or apparatus employed is not critical to the current invention. Rather, the primary focus is to provide a means for maintaining sufficient tension on the continuous, as-spun fibers so as to preclude slack following fiber formation and during the collection process. The constant tension permits alignment of the continuous, fibers in a linear array which may be collected in any manner known to those skilled in the art such as a warp sheet or traversed continuous filament tow.

B. Process for Blow Spinning Continuous Straight Fibers

With continued reference to the drawing, the present invention provides a process for collecting, continuous, blow spun fibers. As known in the art, various collection methods may generate a warp sheet, a traversed continuous fiber tow or other products. As previously noted, the process for blow spinning fibers is well known. However, while the benefits of collecting blow spun fibers in an unidirectional manner were known, they were not achievable prior to the current invention.

According to the process of the present invention, blow spun fibers are formed by passing a spinnable substance through the capillaries of a blow spinning die. When the as-spun fibers exit the capillaries, they are contacted by an attenuating gas. Following attenuation the fibers are optionally passed by a vapor removal system 30 in order to remove any unreacted monomer or solvents which may be entrained in the array of fibers. Preferably, these materials are removed prior to collecting the fibers. This is particularly true when preparing fibers from solvated pitches as the presence of any retained hydrocarbons would degrade the resulting product.

The process of vapor removal will preferably be achieved by the generation of a cross-flow suction. Preferably, the cross-flow suction will occur after fiber attenuation and prior to fiber collection. The cross-flow suction may be generated by one or more blowers, compressors or other suitable device, not shown. The process of vapor removal should not be confused with the common cross-flow quenching step which typically occurs in melt-spinning of fibers. Fibers spun from solvated pitch rapidly quench and thermoset near the die in the region dominated by the rapidly expanding and cooling attenuating gas. Thus, fibers from solvated pitch have already completed the quenching process prior to vapor removal.

Following fiber formation, the current invention utilizes a tensioning device 40 to maintain a constant and uniform force on the fibers. The tension placed on the fibers precludes the bending and possible kinking of the fibers and permits the collection of continuous, infinitely long, blow spun fibers. Further, the application of constant tension following fiber formation permits alignment of the fibers in a linear array which may be collected on a bobbin as a warp sheet or traversed, continuous fiber tow. The impact of the additional tension on the attenuation of the fiber will vary depending upon the spinnable material; however, the additional tension does not operate as the primary attenuating force. Rather, the attenuating gas serves this function.

Once the continuous fiber is aligned on a bobbin or other suitable collection device, the fiber can be cut off for further processing. The manner of removal from the bobbin will determine the characteristics of the final product. If a single cut is made along the length of the bobbin the fiber can be removed as an aligned, unidirectional filament roving cloth with length equal to the circumference of the bobbin. If short, straight and uniform length filaments are required, the fiber can be sliced from the bobbin at specified intervals to achieve the desired filament length. Alternatively, as is known to those skilled in the art, the fibers may be processed on the bobbin, cut to desired lengths after removal or unwound and then drawn, beamed, piddled, or processed in any other manner desired. In addition, rolls, pins, hot chests and other well known devices can be incorporated ahead of or after the continuous fiber is aligned by a tensioning device 40 to accomplish cold or hot drawing and thermal setting functions.

C. Continuous Straight Blow Spun Carbon Fibers

The current invention is particularly useful for spinning continuous, fibers from mesophase pitch and solvated pitches. U.S. Pat. No. 5,648,041, discusses the difficulties of producing straight fibers from solvated pitch and in particular solvated mesophase pitch. As noted therein, the rapid quenching of the fiber in the area of turbulence generated by the attenuating gas tends to generate kinks and bends in the fiber. However, by use of a tensioning device (40) the present invention is provides continuous, blow spun fibers. Further, this invention increases the potential for smaller final diameter products while yielding fibers with higher single filament and composite strength translation. Finally, the current invention may allow spinning die capillary diameters to be larger thereby reducing difficulties associated with small capillaries such as plugging.

Table 1 demonstrates that the fibers of the present invention have improved tensile strength and decreased variation in the as-spun diameter when compared to fibers prepared by prior art methods. The following test results were obtained from fibers spun from a single batch of solvated mesophase pitch using the same blow spinning die. As shown by Table 1, fibers of the current invention, which were collected on a bobbin, had a higher tensile strength and smaller percent coefficient of variation in as-spun diameter than fibers collected as a batt. Percent coefficient of variation (%CV) in fiber diameter is the standard deviation divided by the mean fiber diameter, expressed as a percentage, of a data set. A smaller %CV indicates an improvement in fiber denier uniformity.

TABLE 1

| Coefficient of Variation | | | |
|---|---|---|---|
| Collection Method | Fiber Characteristic | Tensile Strength (Kpsi) | As-Spun Diameter % CV |
| Batt | kinked | 285 | 6.1 |
| Batt | kinked | 278 | 11.2 |
| Bobbin | straight | 378 | 3.9 |
| Bobbin | straight | 420 | 5.8 |

Other embodiments of the present invention will be apparent to those skilled in the art from a consideration of this specification or practice of the invention disclosed herein. The foregoing specification is considered to be merely exemplary, with the true scope and spirit of the invention being indicated by the following claims.

We claim:

1. A process for preparing continuous straight blow spun fibers from a mesophase pitch, said process comprising:

passing said mesophase pitch through capillaries located within a blow spinning die to form said mesophase pitch into fibers;

attenuating said fibers by contracting said fibers with an attenuating gas; and following attenuation, maintaining sufficient tension on said fibers to preclude the formation of slack by collecting said fibers on a receiving device selected from the group consisting of bobbins, rolls and windups and combinations thereof.

2. The process of claim 1, wherein said fibers are collected as either a warp sheet or a traversed continuous filament tow.

3. The process of claim 2, wherein said warp sheet or traversed continuous filament tow is further processed into an unidirectional filament roving fabric.

4. The process of claim 1, wherein prior to collecting said fibers on said receiving device, gases and vapors are removed from said fibers.

5. The process of claim 1, wherein said gases and vapors are removed by cross-flow ventilation applied to the fibers prior to the receiving device.

6. A process for preparing continuous straight blow spun fibers comprising heating a spinnable substance to a temperature sufficient to allow said substance to flow followed by forming continuous fibers by passing said substance into a spinning die and through capillaries located within said die and attenuating said fibers as they exit the capillary by contacting said fibers with at least one stream of gas wherein the improvement comprises:

following attenuation of said fibers, maintaining tension on said fibers by means of a tensioning device selected from the group consisting of bobbins, rolls and windups and combinations thereof.

7. The process of claim 6, additionally including the step of collecting said fibers as a warp sheet or traversed continuous filament tow on a windup device positioned to receive said fibers from said tensioning device.

8. The process of claim 7, including the step of removing gases and vapors prior to collecting said fibers.

9. The process of claim 7, wherein prior to collecting said fibers cross-flow ventilation is applied to the fibers.

* * * * *